US005433600A

United States Patent [19]

Jeng et al.

[11] Patent Number: 5,433,600

[45] Date of Patent: Jul. 18, 1995

[54] BURNER FOR THE COMBUSTION OF COKE OVEN GAS

[75] Inventors: Jing-Lyang Jeng; Jar-Lu Huang; Li-Chiang Chen, all of Hsinchu, Taiwan; Steven J. Bortz, Irvine, Calif.

[73] Assignee: Industrial Technology Research Institute, Taiwan

[21] Appl. No.: 226,822

[22] Filed: Apr. 13, 1994

[51] Int. Cl.[6] ..... F23M 9/00

[52] U.S. Cl. ..... 431/183; 431/185; 431/177; 431/190; 431/351

[58] Field of Search ..... 431/182, 183, 185, 177, 431/190, 351

[56] References Cited

U.S. PATENT DOCUMENTS

| | | | |
|---|---|---|---|
| 3,244,220 | 4/1966 | Kloecker | 431/177 |
| 3,989,444 | 11/1976 | Standinger | 431/177 |
| 4,351,632 | 9/1982 | Nagai | 431/190 |
| 4,842,509 | 6/1989 | Hasenack | 431/10 |
| 4,993,939 | 2/1991 | Fukuda et al. | 431/182 |
| 5,240,410 | 8/1993 | Yang et al. | 431/183 |
| 5,271,729 | 12/1993 | Gensler et al. | 431/177 |

*Primary Examiner*—Carroll B. Dority

*Attorney, Agent, or Firm*—Pollock, Vande Sande & Priddy

[57] ABSTRACT

A burner having a primary flame zone and a secondary flame zone. The throat of the quarl in the center of the primary flame zone is provided with a gas nozzle supported by a swirl element. The orifices of the nozzle are radially and obliquely distributed so that the gas introduced via the frustoconical chamber mixed with the primary air to form a swirl current. The frustoconical chamber extends to the inner surface of the burner to form a circular extended section to restrain the width of the flame; the extended section is parallel to the secondary air inlets distributed on the burner body around the periphery of the frustoconical chamber to effectively control the formation of NOx during combustion.

4 Claims, 2 Drawing Sheets

BURNER FOR THE COMBUSTION OF COKE OVEN GAS

FIELD OF THE INVENTION

The present invention relates generally to a burner, and particularly to a burner for the combustion of coke oven gas.

Common nitrogen-containing gaseous fuel like coke oven gas has an average nitrogen content of over 1000 ppm and a comparatively low heat value. When using conventional burners for the combustion such fuel, in order to maintain the flame stability, it is not possible to simultaneously control the formation of thermal NOx and fuel NOx, and therefore the emission of gas cannot meet the requirement of governmental regulations.

BACKGROUND OF THE INVENTION

U.S. Pat. No. 4,790,743 describes a staged combustion method, in which the flame zones are divided into a primary flame zone which is formed of a supply of coal dust and its carrier air, and the air to fuel ratio is in the range of 0.65–0.9; adjacent to the primary flame zone is the secondary flame zone formed of a supply of reduction fuel injected via reduction fuel nozzles, having a lower air to fuel ratio in the range of 0.5–0.8; and in the final flame zone which is formed of a supply of staged air injected through stage air nozzles, the ratio being in the range of 1.05–1.4. The primary flame zone has a strong internal back flow region due to the arrangement of an adjustable swirling apparatus and a flared burner mouth so as to maintain a high ignition stability.

U.S. Pat. No.4,629,413 discloses a premix burner with stage combustion, in which the burner consists of a primary air-fuel gas combustion assembly and a secondary combustion assembly. The primary combustion assembly has a mixer for premixing fuel gas and the primary air; the secondary combustion assembly has a number of secondary air ports and secondary air inlet means therefor to delay the contact of the secondary air with the main flame so as to reduce the formation of NOx.

In U.S. Pat. No. 4,708,6388, Brazier et al. teaches a method in which the primary combustion air and the secondary combustion air respectively supplied via the primary and secondary air inlets are simultaneously fed into the burner and, by means of a swirler, the primary combustion air, the secondary combustion air, the induced flue gas, and the fuel injected from the nozzle are stirred and mixed in the flame zone.

All of the patents discussed above fail to provide an effective method to maintain the burning intensity and flame stability in the primary flame zone. Also, the mixing of air and fuel in the primary flame zone is not very satisfactory.

SUMMARY OF THE INVENTION

Therefore, the primary object of the present invention is to provide a burner for the combustion of coke oven gas and which simultaneously prevents the formation of NOx and maintains a stable flame to eliminate the drawbacks in prior burners.

Another object of the present invention is to provide a burner in which the primary flame zone is operated under fuel-rich conditions and in the state of incomplete combustion, the fuel is then sufficiently burned in the secondary flame zone so that the heat release pattern in the flame zones are uniformly distributed.

The burner according to the present invention is suitable for application to combustion systems using gaseous fuel of high nitrogen content and low heat value, e.g., gas combustion systems like coke oven gas, and which may significantly reduce the formation of NOx.

The burner of the present invention utilizes nitrogen-containing gaseous fuel as fuel. A set of swirlers with a deviation angle of about 45 degrees are provided in the throat of the burner for creating an internal swirl in the primary flame zone to lower the oxygen content of the gas and peak flame temperature in the primary flame zone, and to enhance the stability of the flame at the same zone, Four secondary air inlets are equally spaced apart around the periphery of the burner; these secondary air inlets are parallel to an extended section of the frustoconical chamber so as to delay the mixing of fuel gas with the secondary air, appropriately separating the primary flame zone and the secondary flame zone so that the heat released in combustion is uniformly distributed, preventing the formation of partially high temperature zones, hence inhibiting the formation of NOx. In prior burners, the burner tile does not have a circular extension; the extended section described herein is a critical feature of the present invention to restrain the profile of the flame and to delay the mixing of fuel gas and secondary air. The coning angle of the frustoconical chamber is configured to be about 40 degrees to match the arrangement of the extended section so that the flame is in a narrow profile, suitably maintaining the flame intensity and stability in the primary flame zone and prolonging the oxgyen-lean conditions of the flame to control the formation of fuel NOx.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
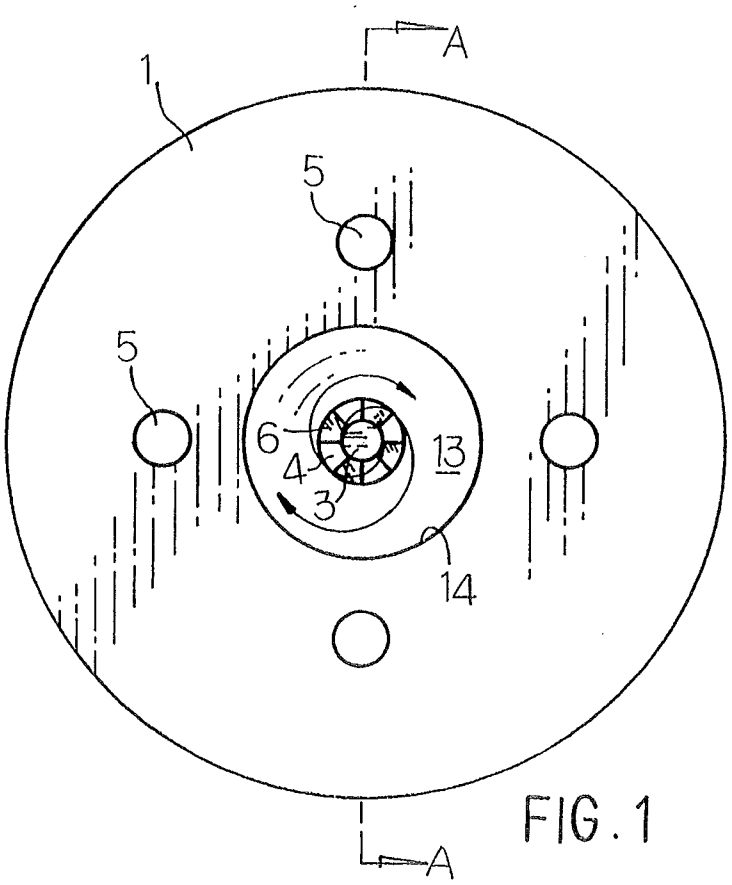
FIG. 1 is a plan view of a preferred embodiment of the burner of the present invention.

The preferred embodiment of the present invention is shown in FIGS. 1, 2, 3 and 4. The present invention relates to an improved primary burner in combustion systems (see FIG. 5), one suitable for burning nitrogen-containing fuel, and particularly in an environment using gas as fuel.

The burner of the present invention comprises a burner body 1 for connecting to a furnace 2, the body 1 having an inner surface 11 and an outer surface 12; a frustoconical chamber 13 is provided in the center of the inner surface 11 of the body 1; a fuel gas nozzle 3 fixed in the center of the frustoconical chamber 13 (the location of the nozzle is what is generally known as throat), its end portion 31 having a plurality of orifices 32; an annular primary air inlet 4 defined by the space between the nozzle 3 and the frustoconical chamber 13; and a plurality of secondary air inlets 5 disposed on the body 1 surrounding the frustoconical chamber 13. One characteristic of the present invention is that the frustoconical chamber 13 extends to form a circular extended section 14 which is parallel to the secondary air inlets 5 and connected to the inner surface 11 of the body 1. Further, the nozzle 3 is supported by at least a swirling element 6 (such as a swirl generating device or the like) in the center of the frustoconical chamber 13, and the orifices 32 of the nozzle 3 are radially and obliquely distributed around the periphery of the end portion 31 of the nozzle 3.

Figure 4:
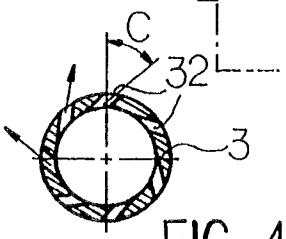
FIG. 4 is a sectional view taken along line B—B of FIG. 3.

The radial deviation angle (C) of the nozzle 3 is, as shown in FIG. 4, in the range of 20 degrees to 50 degrees wherein 45 degrees is preferred. When the nozzle 3 injects fuel gas, the swirling element 6 is caused to rotate so that the injected air forms a swirl current.

Figure 2:
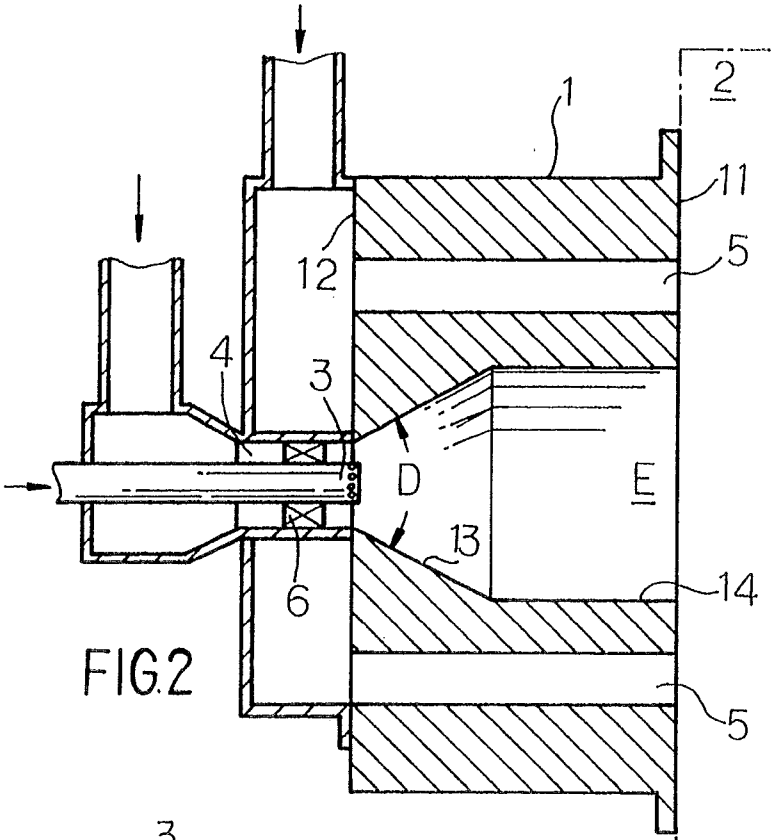
FIG. 2 is a sectional view taken along line A—A of FIG. 1.
Figure 3:
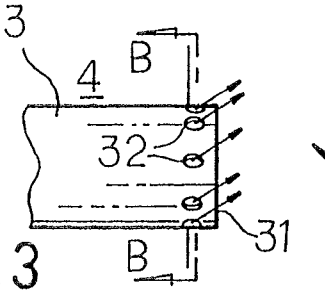
FIG. 3 is an enlarged plan view of the nozzle according to the present invention.

The coning angle (D) of the frustoconical chamber 13 is, as shown in FIG. 2, in the range of 20 degrees and 60 degrees wherein 40 degrees is preferred. This configuration, together with the restraint imposed by the extended section 14, helps keep the shape of the flame so that it may not easily expand, thus maintaining the burning intensity and flame stability in the primary flame zone (E) and prolonging the oxgyen-lean conditions of the flame to control the formation of fuel NOx.

Figure 5:
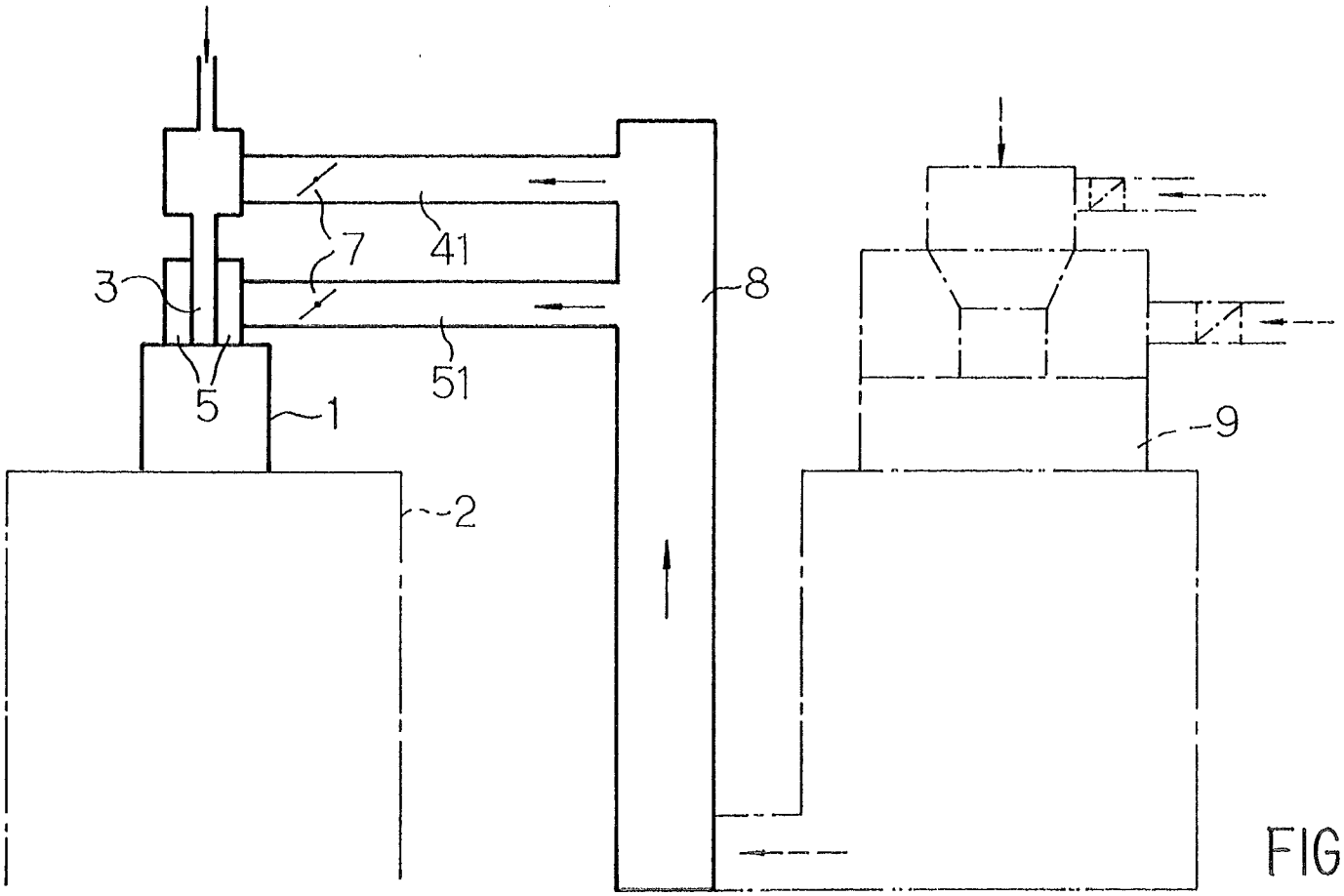
FIG. 5 is an illustrative drawing of the present invention applied to a combustion system.

As shown in FIG. 5, the air supplied to the primary air inlet 4 and secondary air inlets 5 preferably contains 21% of oxgyen, and is preferably preheated air (as that commonly found in coke ovens at steel works) with a temperature preferably about 550 degrees Celsius. In FIG. 5, the preheated air 8 is introduced into the burner via a primary air duct 41 and a secondary air duct 51 each of which is provided with a flow regulating valve 7. The preheated air 8 may be formed in any known method. In the embodiment shown in FIG. 5, the preheated air is generated by a preheater 9.

The burner of the present invention utilizes nitrogen-containing gaseous fuel as fuel. In the throat of the burner are provided a set of swirlers with a deviation angle of about 45 degrees for creating an internal swirl in the primary flame zone to lower the oxggen content of the burnt gas and flame peak temperature in the primary flame zone, and to enhance the stability of the flame at the same time. The coning angle of the frustoconical chamber is configured to be about 40 degrees to match the arrangement of the extended section so that the flame is in a narrow profile, suitably maintaining the flame intensity and stability in the primary flame zone (E) and prolonging the oxgyen-lean conditions of the flame to control the formation of fuel NOx. Four secondary air inlets are equally spaced apart around the periphery of the burner; these secondary air inlets are parallel to an extended section of the quarl so as to delay the mixing of fuel gas with the secondary air, appropriately separating the primary flame zone (E) and the secondary flame zone so that the heat released in combustion is uniformly distributed, preventing the formation of partially high temperature zones, hence inhibiting the formation of NOx.

A model of the burner according to the present invention was constructed and co-tested by the Assignee of the present invention and the Radian Corporation (California, U.S.A.), showing that under the burning conditions of high staged air (primary flame zone having an air to fuel ratio of 0.5), the NOx content of the emitted gas (flue gas) met the requirement of governmental regulations, and that the flame stability was also maintained. Compared to conventional burning technologies, the present invention shows considerable improvement.

Although the present invention has been illustrated and described with reference to the preferred embodiments thereof, it should be understood that it is in no way limited to the details of such embodiments, but is capable of numerous modifications within the scope of the appended claims.

What is claimed is:

1. A burner body for the combustion of coke oven gas, said burner comprising:

a burner for connecting to a furnace, said body having an inner surface and an outer surface;

a frustoconical chamber being provided in the center of said inner surface of said body;

a fuel gas nozzle, the end portion thereof having a plurality of orifices, said nozzle being fixed in the center and throat of said frustoconical chamber;

an annular primary air inlet defined by the space between said nozzle and said frustoconical chamber; and a plurality of secondary air inlets disposed on said body surrounding said frustoconical chamber, wherein said frustoconical chamber extends to form a circular extended section which is parallel to said secondary air inlets and connected to said inner surface of said body, and said nozzle is supported by at least a swirling element coaxial with said frustoconical chamber, and said orifices of said nozzle are directed in a common plane radially and obliquely around the periphery of said end portion of said nozzle and at the throat.

2. A burner as claimed in claim 1 wherein said radial deviation angle of said orifices is in the range of 20 degrees to 50 degrees.

3. A burner as claimed in claim 1 wherein said swirling element is a swirl generating device for causing the injected air to form a swirl current.

4. A burner as claimed in claim 1 wherein said frustoconical chamber has a coning angle that is in the range of 20 degrees to 60 degrees.

* * * * *